US006293756B1

(12) United States Patent
Andersson

(10) Patent No.: US 6,293,756 B1
(45) Date of Patent: Sep. 25, 2001

(54) PUMP

(75) Inventor: Lars Andersson, Uppsala (SE)

(73) Assignee: Amersham Pharmacia Biotech AB, Uppsala (SE)

( * ) Notice: Subject to any disclaimer, the term of this patent is extended or adjusted under 35 U.S.C. 154(b) by 0 days.

(21) Appl. No.: 09/125,920

(22) PCT Filed: Feb. 26, 1997

(86) PCT No.: PCT/SE97/00329

§ 371 Date: Dec. 28, 1998

§ 102(e) Date: Dec. 28, 1998

(87) PCT Pub. No.: WO97/32128

PCT Pub. Date: Sep. 4, 1997

(30) Foreign Application Priority Data

Feb. 27, 1996 (SE) ..... 9600748

(51) Int. Cl.[7] ..... F04B 41/06
(52) U.S. Cl. ..... 417/3; 417/53
(58) Field of Search ..... 417/3, 4, 539, 417/53

(56) References Cited

U.S. PATENT DOCUMENTS 4,233,156 * 11/1980 Tsukada et al. ..... 210/101
4,352,636 * 10/1982 Patterson et al. ..... 417/22
4,359,312 * 11/1982 Funke et al. ..... 417/18

FOREIGN PATENT DOCUMENTS

4130295 * 3/1993 (DE) .
0334994A1 * 10/1989 (EP) .

* cited by examiner

*Primary Examiner*—Henry C. Yuen
*Assistant Examiner*—Mahmoud Gimie
(74) *Attorney, Agent, or Firm*—Royal N. Ronning, Jr.

(57) ABSTRACT

The invention relates to a pump system for providing and maintaining a controlled outflow, comprising a couple of piston pump units (1*a*, 1*b*), having at least two cylinders (2*a*, 2*b*, 2*c*, 2*d*) each with a piston (3*a*, 3*b*, 3*c*, 3*d*) slidably arranged in each cylinder. It further comprises devices for controllably moving the piston in each cylinder, namely by an eccentric wheel (15*a*, 15*b*, 15*c*, 15*d*) for each of the pistons, acting on one end thereof. There is also provided a control unit for dynamically changing the speed of movement of the devices for moving the piston, in response to pressure changes in the system on the pressure side, for maintaining a desired flow out of the pump. The pump system further comprises switching valves (10*a*, 10*b*) for proportioning solutions to be mixed according to a predetermined ratio, the valves being switchable between each source of solutions (A, B, A', B') and are controlled by a control unit having integrating method for integrating the flow during suction from a first source of solution to be mixed, and a method for switching to another source of solution when the integration corresponds to the predetermined proportion of the solution being sucked.

12 Claims, 3 Drawing Sheets

PUMP

The invention relates to a pump system comprising pump units having at least two cylinders and pistons, wherein the pistons are actuated by an eccentric wheel operating according to a soft ware implemented cam profile, in order to operate the movement of the pistons, such that a controllably varying flow out of the pump is obtainable. The pump units operate in an overlapping fashion in order to deliver a continuous, and to the extent possible, constant flow out from the pump unit, without artifacts due to the counter-pressure in the system.

BACKGROUND OF THE INVENTION

A problem with prior art pumps used in HPLC applications has been that there may occur flow fluctuations ("flow spikes") in the system. These "spikes" (positive or negative) are due to the delayed delivery from each pump half because of the need to build up the pressure in the cylinder to correspond to the system pressure. This pressure build-up effect comes from the finite compressibility of liquids, and inherent elasticity in the construction elements of the system. In other words, when one pump cylinder "phases out", i.e. when the piston approaches its end point during the delivery phase, and the flow is beginning to drop to zero, the other pump cylinder taking over needs some time before it can begin to deliver a flow, because of the mentioned need to generate the system pressure level in the liquid inside the cylinder. Thus, it would be desirable if the two cylinders could be synchronized in their respective "phasing in" and "phasing out", such that the flow is maintained constant during this critical phase, and suitably such that the synchronization is adaptable to different system pressure levels. Thus, there exists a need for pumps having variably controllable cam profiles that in addition adapt to the situation at hand.

EP-0 050 296 B discloses a pulsation-free volumetric pump having two plungers reciprocated by a cam so as to provide a combined discharge volume. The pump is characterized by having a DC motor having a mechanical time constant below 12 ms, and by having means for detecting pressure pulsations produced during pumping.

EP-0 334 994 A1 discloses a reciprocating type fluid delivery pump having a drive motor and plungers for driving two pump heads. The pump comprises a converting mechanism for converting rotational motion to a reciprocating motion, including a cam for each plunger. The cams are mounted on a common cam shaft rotating at constant velocity. The cams are machined to have profiles that determine the angle-plunger speed characteristics.

The driving speed is controlled by measuring system pressure and the flow in the system is thereby controllable to a certain extent.

DE-38 37 325 C2 discloses a liquid delivery plunger type pump having a main cylinder and an auxiliary cylinder, both being operated by cams mounted on a common cam shaft.

The pressure is measured and the measurements are used to provide an essentially constant flow.

DE-41 30 295 A1 discloses a pump system having separately driven plunger pumps. The rate of the individual pumps is controlled by feeding back measurement data relating to rotation speed and rotor position. System pressure is not used as a pump control parameter. The pump is said to be suitable for viscous liquids or pastes.

SUMMARY OF THE INVENTION

The main problem that the invention addresses is the elimination of pulsations in the flow on the pressure side in pumps of the type mentioned above, and thus the object of the present invention is to provide a pump that eliminates the problems with prior art pumps discussed above.

This object is achieved with a pump system as described further herein.

DETAILED DESCRIPTION OF A PREFERRED EMBODIMENT

Figure 1:
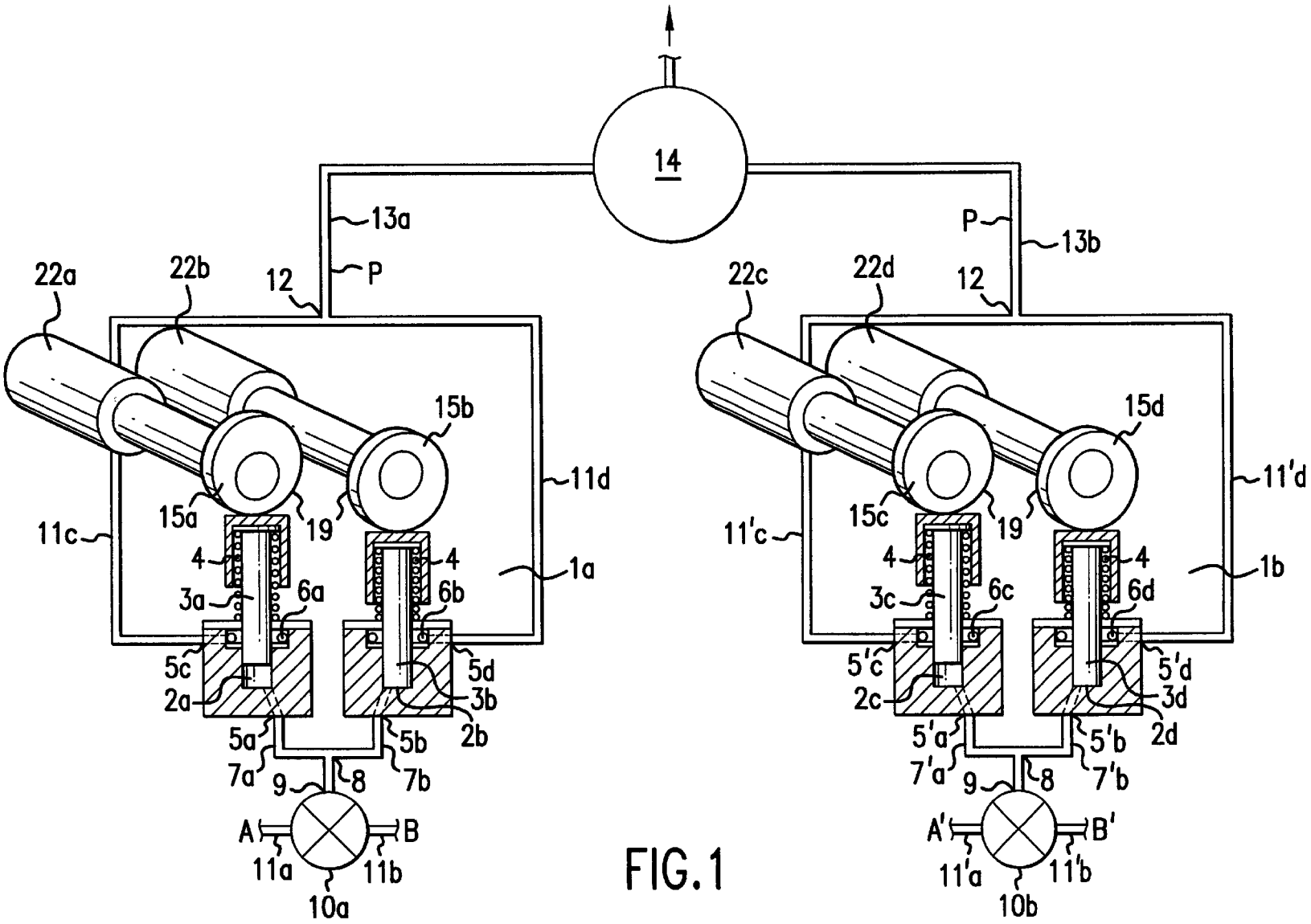
FIG. 1 shows a pump system comprising two pump units wherein the invention may be employed.

In FIG. 1 there is shown pump system according to the invention comprising a first pump unit la and a second pump unit 1*b*, each comprising two separate cylinders 2*a*, 2*b* and 2*c*, 2*d* respectively, with one independently movable piston 3*a*, 3*b* and 3*c*, 3*d* in each cylinder. The pistons are spring 4 biased (this particular detail and certain others common to all cylinders have been given identical reference numerals) towards their maximum extended position, and actuated by an eccentric wheel 15*a*15*b*, 15*c*, 15*d* each. Each cylinder 2*a*, 2*b*, 2*c*, 2*d* is provided with one inlet 5*a*, 5*b*, 5'*a*, 5'*b* and one outlet 5*c*, 5*d*, 5'*c*, 5'*d*, having a ball valve 6*a*, 6*b*, 6*c*, 6*d* each, which open during suction and delivery respectively. The inlets 5*a*, 5*b*, 5'*a*, 5'*b* are connected to a tubing 7*a*, 7*b*, 7'*a*, 7'*b* each which are joined with a T-coupling 8 such as to be connectable to the outlet 9 of a switching valve 10. Said switching valve 10, being operable to switch between two feed lines 11*a*, 11*b*, 11'*a*, 11'*b* from two sources A, B, A', B' of liquid (buffer, acid base etc.), is controlled by software (to be described). The outlets 5*c*, 5*d*, 5'*c*, 5'*d* of each cylinder 2*a*, 2*b*, 2*c*, 2*d* are joined with a T-coupling 12 via feed lines 11*c*, 11*d*, 11'*c*, 11'*d* and the outgoing tube 13*a*, 13*b* from said T-coupling delivers solution to a mixing chamber 14, wherein solution from the two pump units are mixed.

Figure 2A:
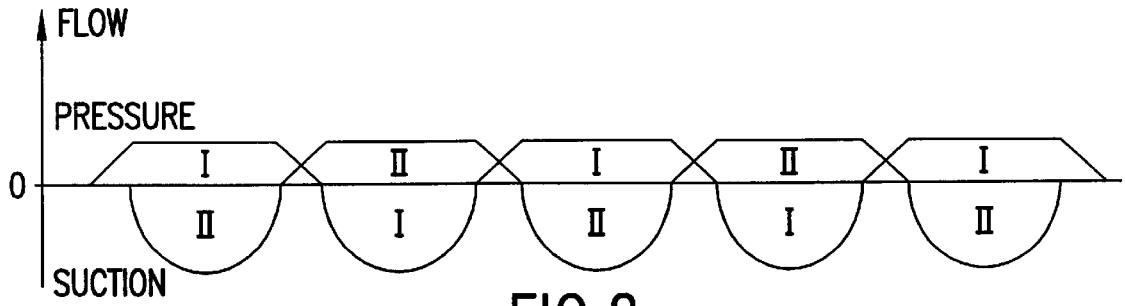
FIG. 2*a* shows the flow profile of a cam operated pump unit.

In FIG. 2*a* there is shown a volume flow through one cam operated pump unit (having two pistons, I and II) as a function of time. As is evident the volume flow varies considerably during the suction phase. As can also be seen in the figure it is possible to maintain a constant flow over a large part of the pressure (or delivery) phase. However, there will of course always be a period of pressure build-up in the beginning of the delivery phase, and a pressure drop at the end of each phase before the pump again reverts to the suction phase (the flow always must pass a state of zero flow). In the shown example, the pressure is maintained constant also during the "phasing in" and "phasing out" of respective pump, since the pressure levels adds up to the general pressure level. This is achieved by letting the delivery phase of pump I overlap with the delivery phase of pump II. However, a given cam profile is only able to perform adequately for a certain system pressure.

Figure 2B:
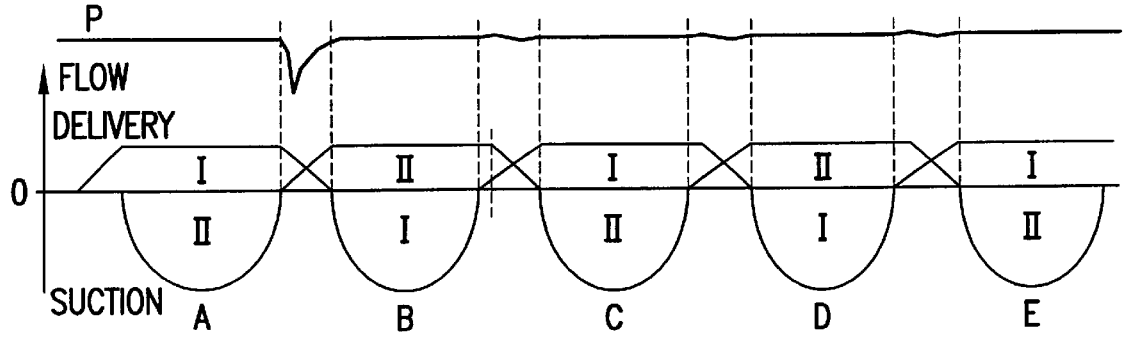
FIG. 2*b* shows the flow profile of a pump operated in accordance with the invention, wherein the compensation for pressure fluctuations at a high counter pressure is shown.
Figure 2C:
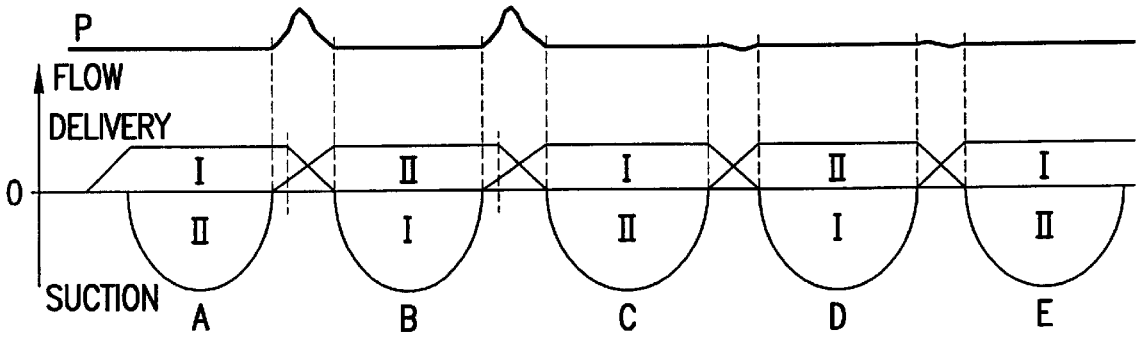
FIG. 2*c* shows the flow profile of the same pump as in FIG. 3, in a situation wherein the pressure conditions have reverted from high to low counter pressure.

In the upper portion FIG. 2*b* there is shown how the flow would vary with system pressure for a given cam profile. Therefore, if a flow free of pulsations is to be achieved, it must be possible to change the starting point of the compression phase, i.e. the starting point of the delivery phase in order to compensate for the counterpressure in the system. This means that the cam profile has to be changed. This is extremely difficult to solve mechanically, if one uses cam disks with cam profiles machined from the material of the cam disk.

Instead of being actuated by a cam disk, the piston of the pump according to the invention is driven by an eccentric member, controlled by soft ware simulating a cam profile. The construction and features of the eccentric member is described below.

Thus, the soft ware controlled eccentric wheel is operated in accordance with the invention such that, as shown in FIG. 2*b*, the first suction phase for the pump designated I, i.e. the second suction in the diagram, is shown to end somewhat earlier on the time scale than the previous suction phase, and thus that the delivery phase following said suction phase begins somewhat earlier. It is important to recognize that of course the areas of the suction phases must be equal, because the cylinders have a given constant volume.

Figure 3:
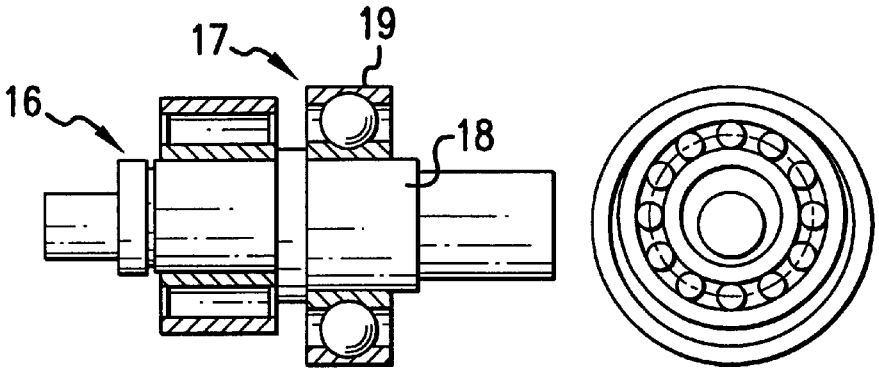
FIG. 3 shows the eccentric wheel of the pump according to the invention.

In FIG. 3 there is shown an assembly of an eccentric axle 16 and a ball bearing 17 (shown in cross section), which constitutes the eccentric wheel 15*a*, 15*b* in FIG. 1, mounted on the eccentric portion 18 of said axle 16. The peripheral surface 19 of said bearing rests against the rear part of each piston as shown in FIG. 1. When the axle 16 is rotated by a stepper motor 22 (see FIG. 5) the eccentric movement of the axle will cause a reciprocating movement of the piston by virtue of the spring action of the pistons.

The eccentric wheel is operated such that it simulates a cam disk, the profile of which is implemented in software. The cam profile is defined in a table (to be described below) that is continuously updated in response to system pressure measurements. The pressure measurement is in a preferred embodiment made by a strain gauge mounted on a membrane at a point before the mixing chamber.

The eccentric wheel is driven by a stepper motor, e.g. one moving 200 full steps per full turn of the outgoing shaft in an at present employed embodiment. Each full step may be further subdivided in 8 additional (sub) steps. A transmission ratio of 1:4 is used such that the stepper motor runs totally 800 full steps or 6400 substeps for one full turn of the eccentric axis. In this way it is possible to define a table having 6400 entries, where each entry corresponds to a time value. These time values define the interval between the pulses that activates the stepper motor to take one substep.

Thus, it is possible to very accurately control the displacement of a piston actuated by the eccentric wheel, by simply letting the stepper motor move in accordance with such a table, wherein the intervals are selected such as to define a cam profile.

Of course it is conceivable and within the scope of the invention to use other actuating means than an eccentric wheel. Thus, one may provide a micrometer type device having a controllable linear displacement, acting on each piston. However, the preferred embodiment comprises an eccentric wheel, because it gives a superior mechanical robustness.

Figure 5:
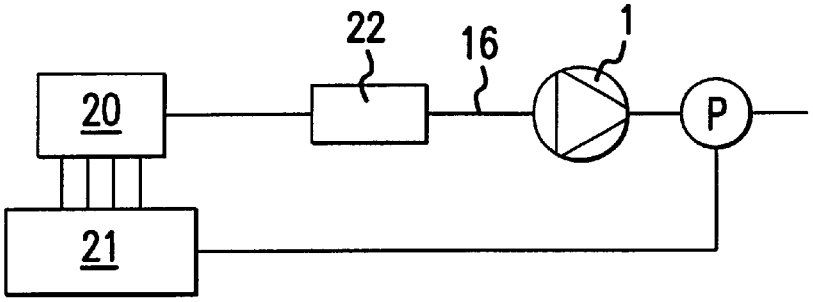
FIG. 5 is a schematic system overview.

As shown in FIG. 5, the system comprises two processors: a slave processor 20 operating according to a current (in any given moment fixed) table, controlling the operation of the stepper motor eccentric wheel(s) 15*a*, 15*b* and thus the pump, and a master 21 that continuously updates a "master" table in response to measurements of the system pressure measured at P. The slave continuously polls the master for updates of the "master table", and updates the current table accordingly.

As already mentioned and discussed, in order to obtain a smooth mixing in the mixing chamber, it would ideally be required that the volume flow out from the pumps corresponds to a straight line as a function of time.

One solution to achieve an approximation of such a situation, is to let the delivery phases of the two pumps overlap, as shown in FIG. 2*a*. This will however still give a fluctuating flow, not enough continuous for the accuracy required in e.g. HPLC or FPLC.

The pump system of the invention utilizes a double piston pump, one for each pair of solutions. The reason is of course that if only a single piston pump is used, the flow would by definition be discontinuous, since the operation is divided in a suction phase and a delivery phase, and no delivery is possible during the suction. Therefore the double piston pump is operated such that the delivery phases of the respective pistons overlap. The pumps are located between respective valve and said mixing chamber, wherein the two mixtures delivered by the pumps are mixed to yield the final solution.

Furthermore, a simple piston pump actuated by an eccentric wheel delivers a sinusoidally varying flow when run at constant speed, and thus even if the phases of the respective pump cylinders overlap, there would be a fluctuation in the outflow unless the movement of the pistons are controlled.

B. The Table

As mentioned previously, the table by which the movement of the eccentric wheel is controlled comprises 6400 values. The slave processor reads the values from this table and supplies pulses to the stepper motor at intervals determined by said table values. Thus, if the values are small the stepper motor will run at a high speed and vice versa.

The system contains a default table which is calculated on the basis of water as the medium and a zero counter pressure.

The updating of the table is performed in response to pressure measurements. If the pressure gradient is positive, i.e. the pressure increases, this means that the stepper motor is running at a too high speed (e.g. depending on the compressibility of the liquid being lower than that for the default, i.e. water). That is, the table values are too small, and the pulses are supplied to the motor at a too high rate. Therefore the master processor recalculates the values corresponding to the portion of the table yielding the incorrect speed. Of course it is possible that the entire table be recalculated.

When a new table has been calculated, the master sends it to the slave together with a replace message. The slave then discards the current table and begins operating in response to the new current table.

This procedure is repeated over at least a couple of pump cycles at the beginning of a run, until a table has been obtained that controls the pump adequately in the sense that there will occur no or at least insignificant pressure fluctuations. The feed back is of course active throughout an entire run, in order to adjust for minor variations.

C. The Valve Algorithm

In the first mixing stage, two different liquids (solutions) are sucked in through a valve which flips over from the feed line for the first solution (A) to the other feed line for the other solution (B) during the suction phase, thereby creating a relation between the amounts of these two solutions being fed via the pump to a mixing chamber (it should be noted that the mixing chamber may be located before the pumps). Of course it would in principle be possible to provide one valve for each feed line, said valves switching between opened and closed positions. The timing of opening and closing may however become more complicated than if one single valve is used.

A first attempt to control the low pressure gradient made use of an entire suction stroke as a reference volume. During the first phase of the suction stroke, corresponding to the fraction of A desired in the mixture, liquid A was sucked in, and when the valve switched at some point in time during this stroke, corresponding to a predetermined volume fraction of B, liquid B began to be sucked. When the next suction phase was begun, an appropriate amount of liquid A was again sucked in and so on. This algorithm works reasonably well, but exhibits a non-desirable pressure dependence. This probably depends on the suction process being non-ideal and is influenced by pressure etc. Also, by using the entire suction volume as the reference, the switching point will always occur at the same point for a given mixture, which yields systematic errors.

In order to remedy these problems the algorithm was altered such that instead of always sucking A and then B during a phase, it alternated the order in each suction phase, i.e. AB, BA, AB etc. This change improved the pressure behavior but instead the fluctuation in the system, i.e. the output gradient, increased. The increased fluctuation probably derives from the fact that the algorithm doubles the volume of respective liquid between each stroke (two doses of B before next A and so on).

A still further improvement in accordance with the present invention resides in letting the valve switch as initially described, but with the exception that it is not periodic over a cylinder volume, i.e. letting the reference volume differ from the suction volume. This method has as a consequence that the reference volume, if it is correctly selected, will be displaced all the time with respect to the beginning and end of the suction phase. The beginning of a suction phase may be at any point within the reference volume.

The advantage of this method is that systematic errors, that occur if the switching is done as described initially, are essentially eliminated, due to the randomness of the position in time of the valve switching point.

Still another important aspect is that the amounts of respective liquids, A and B, is determined by integration over the suction phase. Prior art techniques used simply a time controlled volume calculation for establishing the valve switch point. Thereby the valve switches completely asynchronously with the pump, such that it is open a percentage of the time corresponding to the proportion of respective solution. This principle requires that the valve performs many strokes/switches for every mixer volume exiting the pump, since it delivers a correct concentration only for a time considerably longer than the switch time.

In accordance with the present invention, by virtue of the stepper motor being very accurately stepped in very small increments, it is an easy matter for the skilled man to let a processor integrate a desired volume and to trigger the switching of the valve accordingly. It should be noted that such integration is possible also with DC motors, although it becomes more complicated to implement.

Due to the large dynamic range of the pump it is not suitable to use the same reference volume over the entire flow region. For example if a small reference volume was to be used for a very high flow, the valve would switch at a very high rate, and would wear out too quickly. This has been solved by letting the reference volume increase stepwise, thereby following the increase in flow. This means that at high flow rates the reference volume will be relatively large, because it is of a great interest that the largest operational reference volume can be determined, such that it is possible to establish how much additional trimming of the algorithm must be done. It can be further trimmed if e.g. switching times are considered. Such trimming is however not an aspect of the invention.

The reference volume has been set to 0,75 suction volumes as a default value. This means that it "catches up" with the suction phase in three phases (4*0,75=3). The increment by which the reference volume jumps is set to 0,5 volumes. This volume has been selected such that 4*ReferenceVolume=N* SuctionVolume (N is an integer).

The reference volume is calculated as follows:

For a flow <5,5 ml/min:

ReferenceVolume (RV)=0,75 SuctionVolume (SV)

For a flow>5,5 ml/min:

RV={Int[Flow(ml/min)−5,5 ml/min]/3,7+1}*0,5SV+0,75SV [Int(3/2)=1; Int(1/2)=0 etc.; Thus, Int denotes the integer part of the flow]

EXAMPLE

Figure 4:
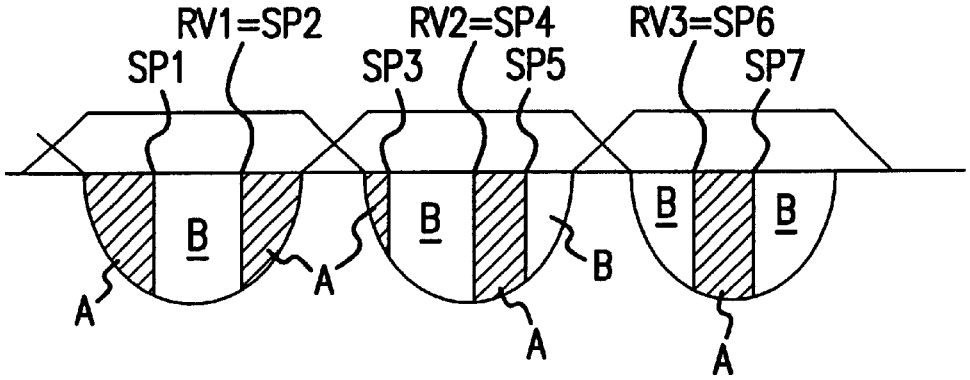
FIG. 4 shows in diagrammatic form the switching points for a valve during a few pump cycles.

In FIG. 4 there is shown schematically how the valve algorithm works.

In the figure the area of the portions below the horizontal "zero"-axis each represent the volume of one stroke of a piston, i.e. one suction volume (SV). In the given example this volume is 0,286 ml.

If we assume a flow of 5 ml/min, the reference volume is 0,75*0,286 ml=0,215 ml. The area up to the thick vertical line RV1 represents the fraction of a suction volume equalling the reference volume (RV). RV1 marks the point where the first reference volume has been reached.

If we assume a desired mixing ratio A:B of 2:3, then the first switching point (vertical line at SP1) of the valve, where solution B begins to be sucked, should be at a point where 0,0858 ml (2/5*0,215 ml) of solution A has been sucked into the cylinder. At SP1 the valve switches to B. Then, the valve switches at RV1, which thus is the same as the second switching point SP2, where it again begins to suck solution A. When another portion (0,0858 ml) of A has been sucked, the valve switches again to B at SP3, and so on, until it after three complete suction phases has caught up. As indicated above there is provided means for integrating the volume during suction so as to find the switching points.

Many modifications and variations are possible to the skilled man within the scope of the inventive concept as brought out in the appended claims.

What is claimed is:

1. A pump system for providing and maintaining a stable flow, comprising a first and a second pump unit, each pump unit comprising i) two cylinders (2*a*, 2*b*) with a piston (3*a*, 3*b*) slidably arranged in each cylinder;

ii) moving means (15*a*, 15*b*, 15*c*, 15*d*, 17, 19) for independently moving the pistons in said cylinders;

iii) stepper motor means (22*a*, 22*b*, 22*c*, 22*d*) for causing said independent movement of each of said moving means (15*a*, 15*b*, 15*c*, 15*d*, 17, 19) to cause said movement of the pistons;

iv) a control unit (21, 22) for dynamically changing the speed of movement of said pistons, in response to measurement data indicative of pressure changes in the system on the pressure side.

2. The pump system as claimed in claim 1, wherein said moving means comprises a respective eccentric wheel (15*a*, 15*b*) for each of said pistons (3*a*, 3*b*), acting on one end thereof.

3. The pump system as claimed in claim 2, wherein the control unit is adapted to change the rate of movement of the pistons by changing the rotational speeds of said stepper motor means (22*a*, 22*b*, 22*c*, 22*d*), on the outgoing axles (16*a*, 16*b*, 16*c*, 16*d*) of which said eccentric wheels are mounted.

4. The pump system as claimed in claim 1, further comprising means (P) for measuring the pressure in the system at a point downstream from said pump (1), the output of said pressure measurement means being supplied to said control unit (21, 22).

5. The pump system as claimed in claim 4, wherein said stepper motor means (22*a*, 22*b*, 22*c*, 22*d*) are operated by feeding actuating pulses to them, the delay between each actuating pulse being set in response to the output from said pressure measurement means.

6. The pump system as claimed in claim 5, wherein said delays are defined in a table, said table being updated in response to the output from said pressure measurement means.

7. The pump system of any preceding claims, further comprising valve means (10) for proportioning solutions to be mixed according to a predetermined ratio, said valve means being switchable to alternate between each source of solutions.

8. The pump system as claimed in claim 7, said valve means being controlled by a control unit having integrating means for integrating the flow during suction from a first source of solution to be mixed, and means for switching to another source of solution when the integration corresponds to the predetermined proportion of the solution being sucked.

9. The pump system as claimed in claim 7, wherein the integration means integrates the flow over a reference volume (RV), said reference volume corresponding to a non-integer multiple of the suction volume (SV).

10. The pump system as claimed in claim 6, wherein the reference volume is set to a larger value with increasing flow through the system.

11. A method of ascertaining a controlled flow out from pump system comprising a piston pump having at least two cylinders each having one independently movable piston arranged therein, and a control unit for controlling the speed of movement of said pistons, comprising i) running the pistons such that the delivery phases of each said cylinder overlap;

ii) measuring the pressure on the delivery side of said pump;

iii) feeding a signal representative of said pressure to a control unit, said control unit increasing or decreasing the speed of movement of said pistons in response to said pressure, to compensate for fluctuations in pressure.

12. The method as claimed in claim 11, wherein said pistons are actuated by an eccentric wheel each, each being driven by a stepper motor means, and wherein said stepper motor means are operated by feeding actuating pulses to them, the delay between each actuating pulse being set in response to the output from said pressure measurement means, and wherein said delays are defined in a table, said table being updated in response to the output from said pressure measurement means.

* * * * *